US005751907A

United States Patent [19]

Moebius et al.

[11] Patent Number: 5,751,907

[45] Date of Patent: May 12, 1998

[54] SPEECH SYNTHESIZER HAVING AN ACOUSTIC ELEMENT DATABASE

[75] Inventors: Bernd Moebius, Chatham; Joseph Philip Olive, Watchung, both of N.J.; Michael Abraham Tanenblatt, New York; Jan Pieter VanSanten, Brooklyn, both of N.Y.

[73] Assignee: Lucent Technologies Inc., Murray Hill, N.J.

[21] Appl. No.: 515,887

[22] Filed: Aug. 16, 1995

[51] Int. Cl.[6] ..... G10L 5/04

[52] U.S. Cl. ..... 395/2.76; 395/2.67; 395/2.69

[58] Field of Search ..... 395/2.69, 2.75, 395/2.76, 2.77, 2.63; 381/43

[56] References Cited

U.S. PATENT DOCUMENTS

| | | | |
|---|---|---|---|
| 3,704,345 | 11/1972 | Coker et al. | 395/2.75 |
| 4,278,838 | 7/1981 | Antonov | 395/2.69 |
| 4,813,076 | 3/1989 | Miller | 395/2.63 |
| 4,820,059 | 4/1989 | Miller et al. | 395/2.63 |
| 4,829,580 | 5/1989 | Church | 381/52 |
| 4,831,654 | 5/1989 | Dick | 395/2.69 |
| 4,964,167 | 10/1990 | Kunizawa et al. | 395/2.69 |
| 4,979,216 | 12/1990 | Malsheen et al. | 395/2.69 |
| 5,204,905 | 4/1993 | Mitome | 395/2.69 |
| 5,235,669 | 8/1993 | Ordentlich et al. | 395/2 |
| 5,283,833 | 2/1994 | Church et al. | 381/41 |
| 5,396,577 | 3/1995 | Oikawa et al. | 395/2.69 |
| 5,490,234 | 2/1996 | Narayan | 395/2.69 |

OTHER PUBLICATIONS

L. R. Rabiner et al. "Digital Models for the Speech Signal", *Digital Processing Of Speech Signals*, pp. 38–55, (1978).

R.W. Sproat et al. "Text–to–Speech Synthesis", *AT&T Technical Journal*, vol. 74, No. 2, pp. 35–44 (Mar./Apr. 1995).

N. Iwahashi et al. "Speech Segment Network Approach for an Optimal Synthesis Unit Set", *Computer Speech and Language*, pp. 1–16 (Academic Press Limited 1995).

H. Kaeslin "A Systematic Approach to the Extraction of Diphone Elements from Natural Speech", *IEEE Transactions on Acoustics, Speech and Signal Processing*, vol. 34, No. 2, pp. 264–271 (Apr. 1986).

J.P. Olive, "A New Algorithm for a Concatenative Speech Synthesis System Using An Augmented Acoustic Inventory of Speech Sounds", *Proceedings of the ESCA Workshop On Speech Synthesis*, pp. 25–30 (1990).

K. Church, "A Stochastic Parts Program and Noun Phrase Parser for Unrestricted Text", *Proceedings of the Second Conference on Applied Natural Language Processing*, pp. 136–143 (1988).

J. Hirschberg, "Pitch Accent in Context: Predicting International Prominence From Text", *Artificial Intelligence*, vol. 63, pp. 305–340 (1993).

R. Sproat, "English Noun–Phrase Accent Prediction for Text–to–Speech", *Computer Speech and Language*, vol. 8, pp. 79–94 (1994).

(List continued on next page.)

*Primary Examiner*—Allen R. MacDonald
*Assistant Examiner*—Vijay Chawan
*Attorney, Agent, or Firm*—Robert E. Rudnick

[57] ABSTRACT

A speech synthesis method employs an acoustic element database that is established from phonetic sequences occurring in an interval of a speech signal. In establishing the database, trajectories are determined for each of the phonetic sequences containing a phonetic segment that corresponds to a particular phoneme. A tolerance region is then identified based on a concentration of trajectories that correspond to different phoneme sequences. The acoustic elements for the database are formed from portions of the phonetic sequences by identifying cut points in the phonetic sequences which correspond to time points along the respective trajectories proximate the tolerance region. In this manner, it is possible to concatenate the acoustic elements having a common junction phonemes such that perceptible discontinuities at the junction phonemes are minimized. Computationally simple and fast methods for determining the tolerance region are also disclosed.

22 Claims, 5 Drawing Sheets

OTHER PUBLICATIONS

C. Coker et al., Morphology and Rhyming: Two Powerful Alternatives to Letter–to–Sound Rules for Speech, *Proceedings of the ESCA Workshop On Speech Synthesis*, pp. 83–86 (1990).

J. van Santen, "Assignment of Segmental Duration in Text–to–Speech Synthesis", *Computer Speech and Language*, vol. 8, pp. 95–128 (1994).

L. Oliveira, "Estimation of Source Parameters by Frequency Analysis", *ESCA Eurospeech–93*, pp. 99–102 (1993).

M. Anderson et al., "Synthesis by Rule of English Intonation Patterns", *Proceedings of the International conference on Acoustics, Speech and Signal Processing*, vol. 1, pp. 2.8.1–2.8.4 (1984).

R. Sproat, et al. "A Modular Architecture For Multi–Lingual Text–To–Speech", *Proceedings of ESCA/IEEE Workshop on Speech Synthesis*, pp. 187–190 (1994).

H. Kaeslin, "A Comparative Study Of The Steady–State Zones Of German Phones Using Centroids In The LPC Parameter Space", *Speech Communication*, vol. 5, pp. 35–46 (1986).

SPEECH SYNTHESIZER HAVING AN ACOUSTIC ELEMENT DATABASE

FIELD OF THE INVENTION

The invention relates to speech synthesis in general and more specifically, to a database containing acoustic elements for use in speech synthesis.

BACKGROUND OF THE INVENTION

Rule-based speech synthesis is used for various types of speech synthesis applications including text-to-speech and voice response systems. A typical rule-based speech synthesis technique involves concatenating diphone phonetic sequences taken from recorded speech to form new words and sentences. One example of this type of text-to-speech synthesizer is, for example, the TTS System manufactured by an affiliate of the assignee of the present invention which is described in R. W. Sproat and J. P. Olive, "Text-to-Speech Synthesis", *AT&T Technical Journal*, Vol. 74, No. 2, pp. 35–44 (March/April 1995), which is incorporated by reference herein.

A phoneme corresponds to the smallest unit of speech sounds that serve to distinguish one utterance from another. For instance, in the English language, the phoneme /r/ corresponds to the sound for the letter "R". A phonetic segment is a particular utterance of a phoneme. In a similar manner, a phonetic sequence is a speech interval of a sequence of adjacent phonetic segments. A diphone phonetic sequence is a phonetic sequence that start in a substantially center portion of one phonetic segment and ends in the substantially center portion of the next phonetic segment. As a result, a diphone corresponds to a transition from one phoneme to the next.

Typically, the center portion of a phonetic segment corresponding to a phoneme has substantially steady-state acoustic characteristics that do not vary drastically over time. Accordingly, any discontinuity formed at a junction between two concatenated phonetic sequences should be relatively small. However, concatenating phonetic sequences taken from different utterances often produces perceptible discontinuities that impair the intelligibility of the resulting acoustic signal.

Speech synthesis methods that address this discontinuity problem include those described in N. Iwahashi and Y. Sagisaka, "Speech Segment Network Approach for an Optimal Synthesis Unit Set", *Computer Speech and Language*, pp. 1–16 (Academic Press Limited 1995) (Iwahashi et al. article), and H. Kaeslin, "A Systematic Approach to the Extraction of Diphone Elements from Natural Speech", *IEEE Transactions on Acoustics, Speech and Signal Processing*, Vol. 34, No. 2, pp. 264–271 (April 1986) (Kaeslin article), which are incorporated by reference herein.

The method of the Iwahashi article uses optimization techniques to select diphone phonetic sequences from prerecorded speech that can be recombined with reduced discontinuities or inter-segmental distortion. In particular, this method determines values for the inter-segmental distortions of the multitude of combinations of different phonetic sequences extracted from recorded speech. The resulting distortion values are then evaluated using mathematical optimization to select the overall best sequence for each diphone used in a particular language. However, this method is excessively computationally complex and would likely require special computers or undesirable long periods of computing time. Also, although the diphone phonetics start in the steady-state center of one phonetic segment and end in the steady-state center of the next phonetic segment, there are often particular points in the center regions that when used as cut points produce sequences that achieve reduced concatenation discontinuities. Accordingly, the reduction in inter-segment distortion is substantially dependent on the quality of the selection of the particular start and end cut points for each of the phonetic sequences. These out points are typically determined by a human operator who extracts the sequences from the recorded speech without knowing which cut points offer significant advantages.

The Kaeslin article discloses a method that attempts to determine the optimal start and end cut points in order to minimize concatenation discontinuities. This method produces trajectories for formant frequencies of all diphone phonetic sequences that contain a phonetic segment corresponding to a particular phoneme. Formant trajectories are a time-dependent graphical depiction of the measured resonance frequencies composing an utterance. The method then determines a centroid vector based on these trajectories. The article defines a centroid vector as a vector that "minimizes the sum of the squares between itself and the closest points on a set of trajectories . . . . Distances are measured by means of the log area ratio distance." The method then cuts the phonetic sequences from the recorded speech to form diphone database elements at time points corresponding to the points on the trajectories closest to the centroid vector.

However, determination of the centroid vector is very difficult and is based initially on a "best guess" by a human operator. Due to the nature of the trajectories, if a poor "best guess" is made, then a centroid vector can improperly be determined proximate a set of local trajectories when, in fact, the actual centroid vector for all the trajectories is elsewhere. The use of an improper centroid vector causes sequence cut points that yield no or unacceptably small reduction in discontinuities.

Thus, a need exists for an acoustic segment database building method that automatically determines the proper cut points for each segment that substantially minimizes discontinuities in resulting concatenated segments.

SUMMARY OF THE INVENTION

A speech synthesizer employs an acoustic element database that includes acoustic elements formed from selected phonetic sequences extracted from a speech signal at particular cut points. In accordance with the present invention, these cut points correspond to trajectory time points that are within or close to a tolerance region. The size of the tolerance region should be predetermined such that a minimum desired sound quality is achieved in concatenated acoustic elements whose cut points of a junction phonetic segment correspond to time points within extreme portions of the tolerance region. The positioning of the tolerance region is determined based on a concentration of trajectories corresponding to different phoneme sequences. For instance, it is possible for the tolerance region to be a region of a representational space, in which the trajectories are formed, that corresponds to a highest concentration of trajectories corresponding to different phoneme sequences. In other words, the region that is intersected by or closest to the substantially largest number of such trajectories.

Thus, the invention relies on a substantial and unexpected benefit achieved by employing a heightened diversity of trajectories in determining the position of the tolerance region. This diversity enables the invention to more accurately select particular phonetic sequences and cut points for formation of acoustic elements that achieve a reduction in concatenation discontinuities.

In accordance with one embodiment of the present invention, the representational space for the trajectories are covered by a plurality of contiguous cells. In such an embodiment, it is possible to employ a grid search of the cells to determine the tolerance region by identifying the region of at least one cell that is intersected by a greater than average number of trajectories that correspond to different phoneme sequences.

In accordance with another embodiment of the present invention, the cells that are within a region surrounding each time point along a trajectory are identified. For each identified cell, a list maintained for that cell is updated with the identity of the phoneme sequence for that trajectory. However, the identity of the particular phoneme sequence should not added to a cell list if it already appears on that list. Since the method only examines and updates those cells that are within resolution regions of the trajectory time points it is faster than the grid search method which examines each cell in the representational space individually. Further, since an identity of a phoneme sequence is added a single time to a list, diversity of trajectories is achieved in determining the tolerance region.

Further, the lists of the cells can be characterized by an indexed data structure to facilitate the updating of the lists for cells within the particular region around a trajectory time point. In this manner, the trajectory time points can be converted to index values using a conversion factor. Then, resolution values can be added and subtracted from the converted indexed values to determine the index values of the cell lists that correspond to the cells within the particular region. The cell with the longest list can then easily be identified for determination of the tolerance region.

Thus, an acoustic element database can be produced in a computationally simple and fast manner without the requirement of special computers or long processing times in accordance with the present invention. Such a database has relatively small memory requirements and contains acoustic elements that can be concatenated into relatively natural-sounding synthesized speech. Since the acoustic elements are selected from the speech signal using cut points based on a respective tolerance region, the number of perceptible discontinuities that occur during concatenation are reduced.

Additional features and advantages of the present invention will become more readily apparent from the following detailed description and accompanying drawings.

DETAILED DESCRIPTION

Figure 1:
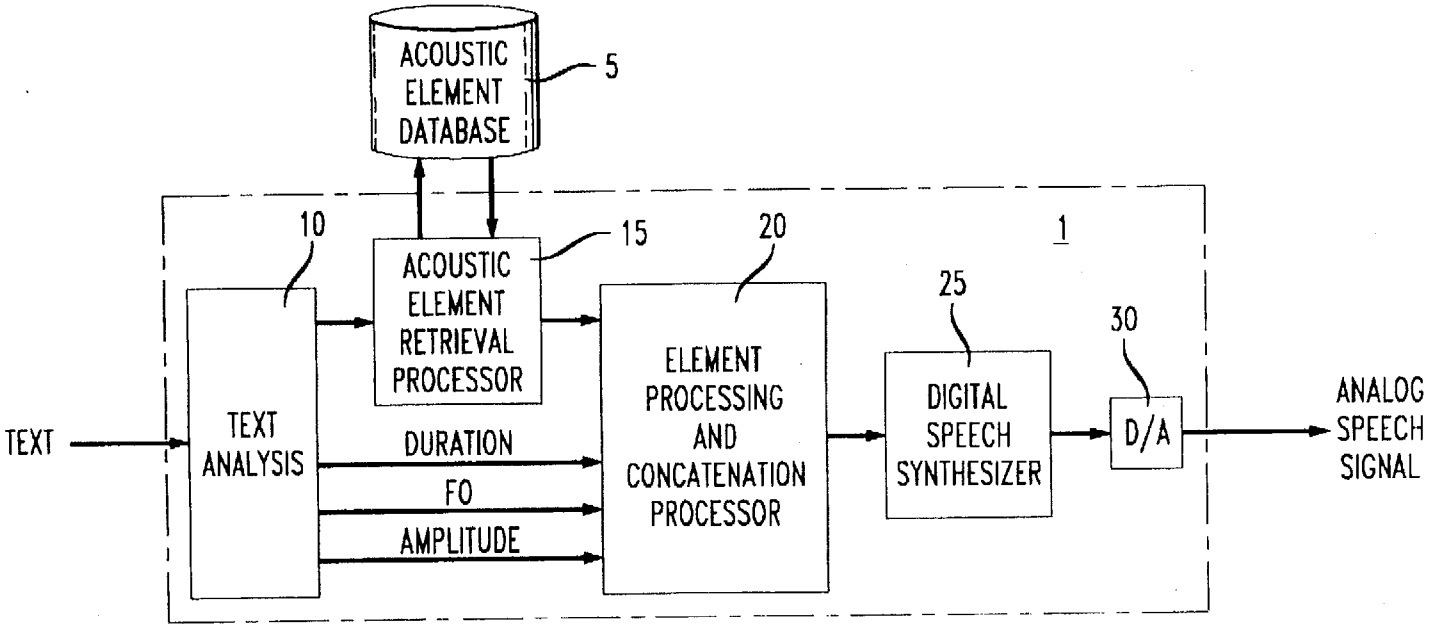
FIG. 1 illustrates a schematic block diagram of an exemplary text-to-speech synthesizer employing an acoustic element database in accordance with the present invention.

An exemplary text-to-speech synthesizer 1 employing an acoustic element database 5 in accordance with the present invention is shown in FIG. 1. For clarity of explanation, functional components of the text-to-speech synthesizer 1 are represented by boxes in FIG. 1. The functions executed in these boxes can be provided through the use of either shared or dedicated hardware including, but not limited to, application specific integrated circuits, or a processor or multiple processors executing software. Use of the term "processor" and forms thereof should not be construed to refer exclusively to hardware capable of executing software and can be respective software routines performing the corresponding functions and communicating with one another.

In FIG. 1, it is possible for the database 5 to reside on a storage medium such as computer readable memory including, for example, a CD-ROM, floppy disk, hard disk, read-only-memory (ROM) and random-access-memory (RAM). The database 5 contains acoustic elements corresponding to different phoneme sequences or polyphones including allophones. (Allophones are variants of phonemes based on surrounding speech sounds. For example, the aspirated /p/ of the word pit and the unaspirated /p/ of the word split are allophones of the phoneme /p/.)

In order for the database 5 to be of modest size, the acoustic elements should generally correspond to a limited sequences of phonemes, such as one to three phonemes. The acoustic elements are phonetic sequences that start in the substantially steady-state center of one phoneme and ends in the steady-state center of another phoneme. It is possible to store the acoustic elements in the database 5 in the form of linear predictive coder (LPC) parameters or digitized speech which are described in detail in, for example, J. P. Olive, "A New Algorithm for a Concatenative Speech Synthesis System Using an Augmented Acoustic Inventory of Speech Sounds", *Proceedings of the ESCA Workshop on Speech Synthesis*, pp. 25–30 (1990), herein. which is incorporated by reference herein.

The text-to-speech synthesizer 1 includes a text analyzer 10, acoustic element retrieval processor 15, element processing and concatenation (EPC) processor 20, digital speech synthesizer 25 and digital-to-analog (D/A) converter 30. The text analyzer 10 receives text in a readable format, such as ASCII format, and parses the text into words and further converts abbreviations and numbers into words. The words are then separated into phoneme sequences based on the available acoustic elements in the database 5. These phoneme sequences are then communicated to the acoustic element retrieval processor 15.

Methods for the parsing of words into phoneme sequences and the abbreviation and number expansion are described in, for example, K. Church, "A Stochastic Parts Program and Noun Phrase Parser for Unrestricted Text", *Proceedings of the Second Conference on Applied Natural Language Processing*, pp. 136–143 (Morristown, N.J. 1988); J. Hirschberg, "Pitch Accent in Context: Predicting International Prominence From Text", *Artificial Intelligence*, vol. 63, pp. 305–340 (1993); R. Sproat, "English Noun-Phrase Accent Prediction for Text-to-Speech", *Computer Speech and Language*, vol. 8, pp. 79–94 (1994); and C. Coker et al., "Morphology and Rhyming: Two Powerful Alternatives to Letter-to-Sound Rules for Speech, *Proceedings of the ESCA Workshop on Speech Synthesis*, pp. 83–86 (1990), which are all incorporated by reference herein.

The text analyzer 10 further determines duration, amplitude and fundamental frequency of each of the phoneme sequences and communicates such information to the EPC processor 20. Methods for determining the duration include those described in, for example, J. van Santen, "Assignment of Segmental Duration in Text-to-Speech Synthesis", *Computer Speech and Language*, vol. 8, pp. 95–128 (1994), which is incorporated by reference herein. Methods for determining the amplitude of a phoneme sequence are described in, for example, L. Oliveira, "Estimation of Source Parameters by Frequency Analysis", *ESCA EUROSPEECH*-93, pp. 99–102 (1993), which is also incorporated by reference herein. The fundamental frequency of a phoneme is alternatively referred to as the pitch or intonation of the segment. Methods for determining the fundamental frequency or pitch are described in, for example, M. Anderson et al., "Synthesis by Rule of English Intonation Patterns", *Proceedings of the International Conference on Acoustics, Speech and Signal Processing*, vol. 1, pp. 2.8.1–2.8.4 (San Diego 1984), which is further incorporated by reference herein.

The acoustic element retrieval processor 15 receives the phoneme sequences from the text analyzer 10 and then selects and retrieves the corresponding proper acoustic element from the database 5. Acoustic element selection methods are described in, for example, the above cited Olive reference. The retrieved acoustic elements are then communicated by the acoustic element retrieval processor 15 to the EPC processor 20. The EPC processor 20 modifies each of received acoustic elements by adjusting their fundamental frequency and amplitude, and inserting the proper duration based on the corresponding information received from the text analyzer 10. The EPC processor 20 then concatenates the modified acoustic elements into a string of acoustic elements corresponding to the text input of the text analyzer 10. Methods of concatenation for the EPC processor 20 are described in the above cited Oliveira article.

The string of acoustic elements generated by the EPC processor 20 is provided to the digital speech synthesizer 25 which produces digital signals corresponding to natural speech of the acoustic element string. Exemplary methods of digital speech synthesis are also described in the above cited Oliveira article. The digital signals produced by the digital speech synthesizer 25 are provided to the D/A converter 30 which generates corresponding analog signals. Such analog signals can be provided to an amplifier and loudspeaker (not shown) to produce natural sounding synthesized speech.

Figure 2A:
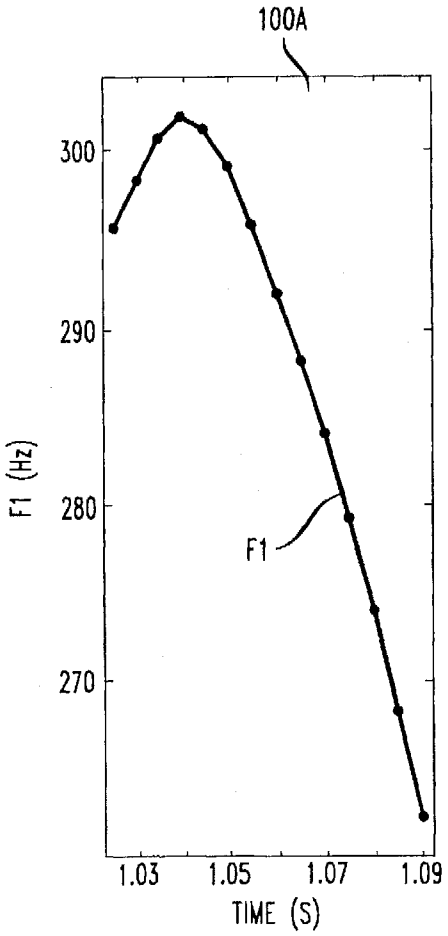
FIG. 2A–2C illustrate speech spectrograms of exemplary formants of a phonetic segment.
Figure 2B:
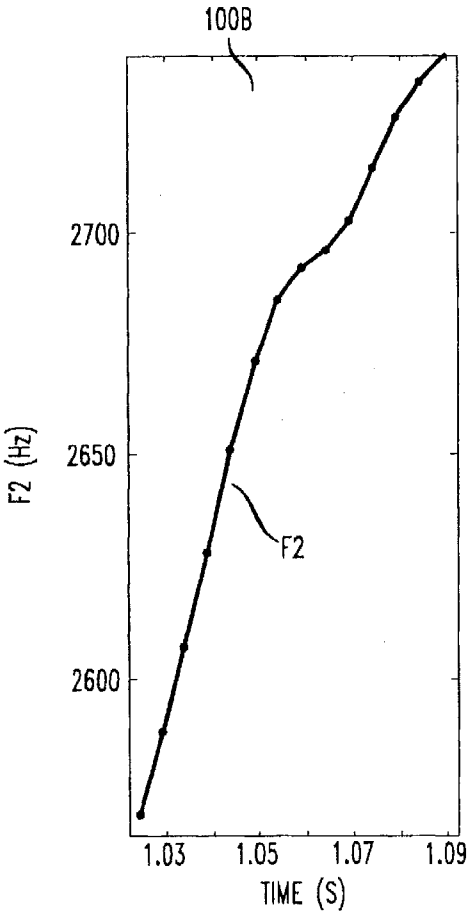
Figure 2C:
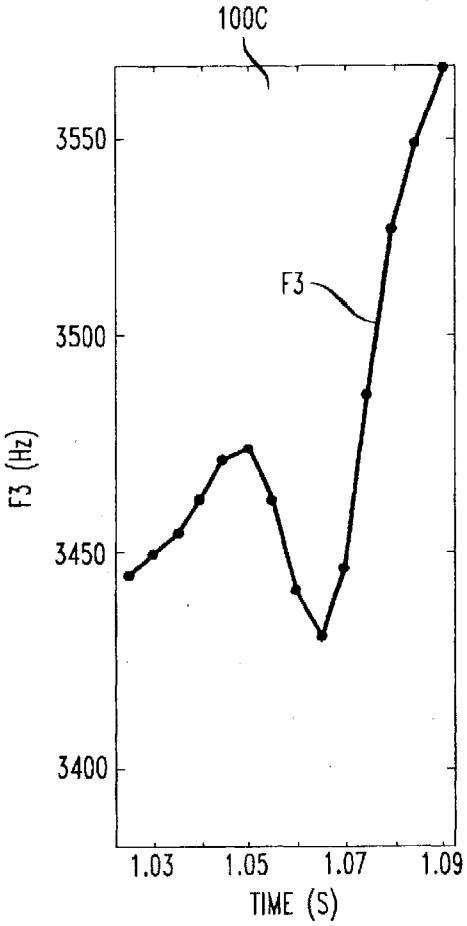

A characteristics of phonetic sequences over time can be represented in several representations including formants, amplitude and any spectral representations including ceptral representations or any LPC derived parameters. FIG. 2A–2C show speech spectrograms 100A, 100B and 100C of different formant frequencies or formants F1, F2 and F3 for a phonetic segment corresponding to the phoneme /i/ taken from recorded speech of a phoneme sequence /p–i/. The formants F1–F3 are trajectories that depict the different measured resonance frequencies of the vocal tract of the human speaker. Formants for the different measured resonance frequencies are typically named F1, F2, . . . , based on the spectral energy that is contained by the respective formants.

Formant frequencies depend upon the shape and dimensions of the vocal tract. Different sounds are formed by varying the shape of the vocal tract. Thus, the spectral properties of the speech signal vary with time as the vocal tract shape varies during the utterance of the phoneme segment /i/ as is depicted in FIGS. 2A–C. The three formants F1, F2 and F3 are depicted for the phoneme /i/ for illustration purposes only. It should be understood that different numbers of formants can exist based on the shape of the vocal tract for a particular speech segment. A more detailed description of formants and other representations of speech is provided in L. R. Rabiner and R. W. Schafer, "Digital Processing of Speech Signals" (Prentice-Hall, Inc., N.J., 1978), which is incorporated by reference herein.

As is stated above with regard to FIG. 1, the acoustic elements stored in the database 5 correspond to phonetic sequences that start in the substantially center portion of one phoneme and ends in the center portion of another phoneme. Differences in characteristics, such as spectral components, at the junction phoneme of two concatenated acoustic elements produce a discontinuity that could cause the synthesized speech to be intelligible or difficult to understand. However, within a region of phonetic segments corresponding to the center region of a phoneme there are often particular cut points within a region having steady-state characteristics that can be used to produce acoustic elements that achieve a reduction in the concatenation discontinuities. The respective trajectories F1–F3 in FIGS. 2A–C represent the characteristics of the phonetic sequences at a center region of the particular phoneme. It is desirable to select cut points in the phonetic sequences to form acoustic elements that minimize concatenation discontinuities.

Figure 3:
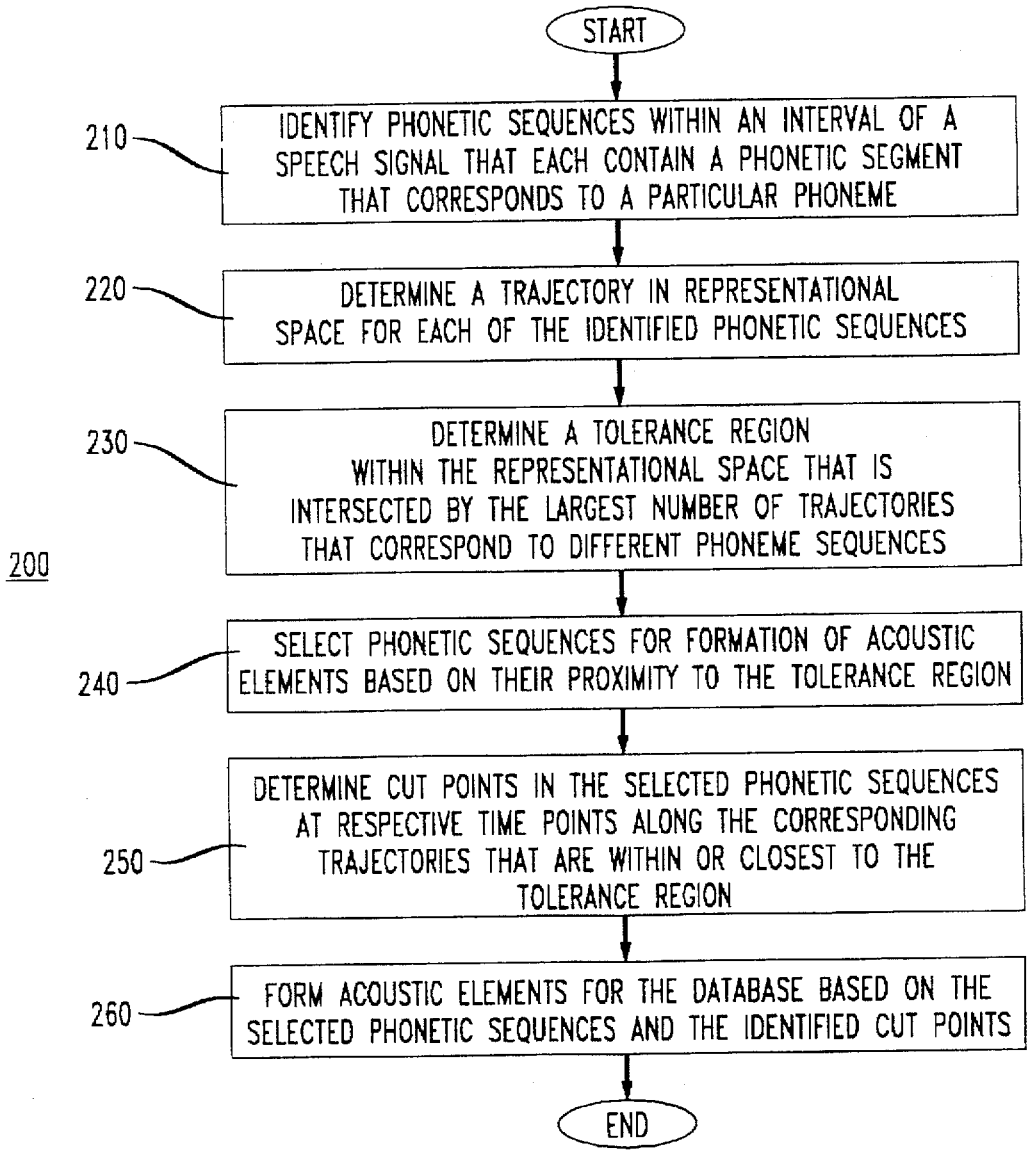
FIG. 3 illustrates a flow chart of an exemplary method in accordance with the present invention for forming the acoustic element database of FIG. 1.

FIG. 3 depicts an exemplary method 200 in accordance with the present invention that selects particular phonetic sequences from a speech signal and determines corresponding cut points of the selected phonetic sequences for forming the acoustic elements of the database 5. According to the method 200, phonetic sequences that contain a phonetic segment corresponding to a particular phoneme are identified from an interval of a speech signal in step 210. Each phonetic sequence should correspond to a sequence of at least two phonemes. It is possible for the speech signal to be obtained from recorded speech or directly from a human speaker. Further, if the source of the speech signal is recorded speech then the recorded speech can further be processed to produce a segmented and labeled speech signal to facilitate operation of the method 200. A segmented and labeled speech signal is a speech signal with the corresponding phonetic sequences labeled and the approximate boundaries between sequences identified.

Trajectories are then determined in step 220 for at least a portion of each of the phonetic sequences corresponding to the particular phoneme. The trajectories are a representation of at least one acoustic characteristic of the portion of the phonetic sequence over time. It is possible for the trajectories to be a discrete sequence representing the acoustic characteristic or a continuous representation of the acoustic characteristic over the period of time. Examples of suitable acoustic characteristics which can be used for the trajectories include spectral representations, such as, for example, formant frequencies, amplitude and spectral tilt representations and LPC representations. Other acoustic characteristics whether frequency-based or otherwise can be used for the trajectories in accordance with the present invention. Exemplary trajectories of a single formant frequency representations is shown in each of FIGS. 2A–C.

In step 220, the trajectories are determined in a representational space. As used herein, a representational space is the domain in which a trajectory can be described as a function of the parameters that characterize that trajectory. For instance, the representational space for a single formant trajectory, as shown in FIG. 2A, illustrates frequency as a function of time. It is possible to form a single trajectory based on two or more formant frequencies for a particular phonetic sequence. For such a trajectory, the representational space would have an axis for each of the represented formal frequencies. It is possible for frequency points along each trajectory to be labeled with the corresponding times at which such frequencies have occurred in the phonetic sequence. For example, a two-formant frequency trajectory would be formed in two-dimensional space as a curve wherein the corresponding times of the curve points are indicated at 5 ms intervals.

After the trajectories are determined in the representational space, a position of a tolerance region is determined in step 230 based on the concentration of trajectories that correspond to different phoneme sequences. The tolerance region is a N-dimensional region in the N-dimensional representational space that is intersected or closest to a relatively high concentration of trajectories that correspond to different phoneme sequences. For instance, it is possible for the tolerance region to be a region that is intersected by or closest to the a largest number of trajectories that correspond to different phoneme sequences. The size of the tolerance region should be predetermined such that a minimum desired sound quality is achieved in concatenating acoustic elements where cut points of a junction phoneme correspond to time points within extreme portions of the tolerance region. Particular methods for determining the proper tolerance region is described in greater detail below with regard to FIGS. 4 and 5.

After the position of the tolerance region is determined, then, in step 240, particular phonetic sequences are selected for formation of the acoustic elements based on the proximity of the corresponding trajectories to the tolerance region. For instance, if several phonetic sequences in the speech signal correspond to the same phoneme sequence, then the phonetic sequence whose corresponding trajectory is closest to or within the tolerance region is selected in order to form the acoustic element.

After the phonetic sequences are selected in step 240, then in step 250, respective cut points are determined within the phonetic sequences to obtain the desired acoustic element. The cut points correspond to time points along the trajectories which are substantially closest to or within the tolerance region. Lastly, in step 260, acoustic elements are formed based on the selected phonetic sequences and their corresponding cut points. If all the phonetic sequences identified in step 210 are to form acoustic elements, whether because only one phonetic sequence exists in the speech signal for each desired phoneme sequence or otherwise, then step 240 may be omitted.

In accordance with the present invention, the position of the tolerance region is based on the trajectories corresponding to different phoneme sequences. In this manner, the present invention achieves a heightened diversity in determining the position of the tolerance region by using less than the total number of trajectories for the phonetic sequences from the speech signal. This diversity enables the invention to more accurately select particular phonetic sequences and cut points for formation of acoustic elements that achieve a reduction concatenation discontinuities. If the position of a tolerance region is a region of the highest concentration of trajectories corresponding to different phoneme sequences then the acoustic elements would produce synthesized speech of a relatively high sound quality. However, if slightly diminished sound quality is acceptable then a tolerance region having less than the highest concentration of trajectories can be used in accordance with the present invention.

An exemplary technique for determining the tolerance region in accordance with the method 200, is to divide the representational space in which the trajectories are determined into respective cells and identify the particular cell or region of cells having at least a minimum desired level of concentration of trajectories. An exemplary operation of the method 200 in accordance with this technique will now be described with respect to an exemplary trajectory graph 300 shown in FIG. 4. Referring to FIG. 3, phonetic sequences containing phonetic segments corresponding to the phoneme /i/ are identified in an interval of recorded speech in step 210. The phonetic sequences correspond to the phoneme sequences /lid/, /lik/, /mik/, /gim/, /din/ and five phonetic sequences correspond to the phoneme sequence /kit/. The acoustic elements that could be formed form these phonetic sequences include diphones [l–i], [i–d], [i–k], [m–i], [g–i], [i–m], [d–i], [i–n], [k–i] and [i–t]. Although the discussion of FIG. 4 concerns the construction of acoustic elements that are diphones, it should be understood that acoustic elements of larger phoneme sequences can be constructed in accordance with the present invention by performing the method 200 of FIG. 3 on the particular boundary phonemes of the corresponding larger phonetic sequences.

Figure 4:
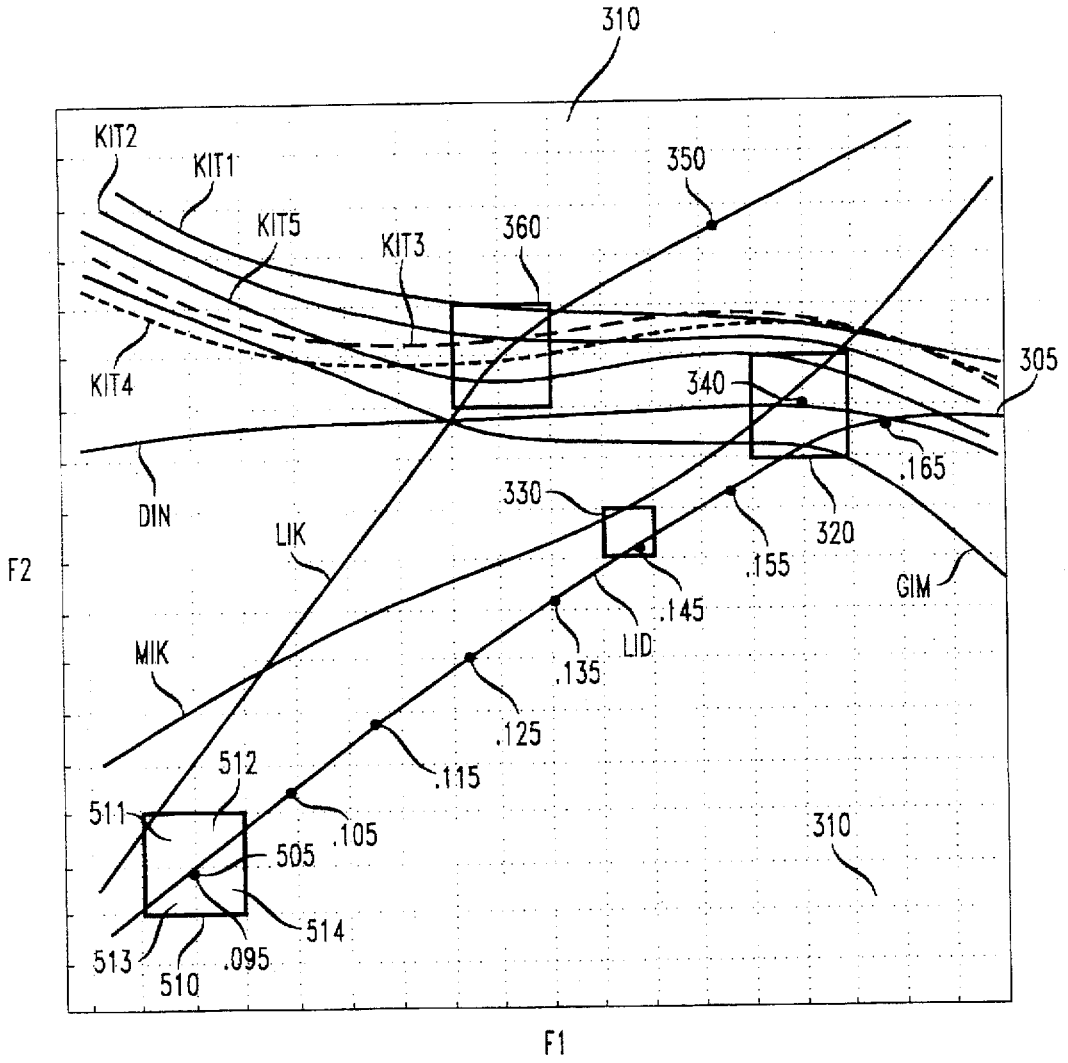
FIG. 4 illustrates a graph of exemplary trajectories for phonetic sequences for use in the method of FIG. 3.

For each of the phonetic sequences identified in step 210, two-formant trajectories are formed for each of the phonetic sequences in step 220. The trajectory graph 300 shown in FIG. 4 illustrates these trajectories in a two-formant representational space that is divided into a plurality of cells 310. In FIG. 4, each trajectory is labeled with the identity of its corresponding phoneme sequence. For example, the trajectory 305 is determined from a phonetic sequence corresponding to the phoneme sequence /lid/ and is labeled with "LID" accordingly. The five occurrences of the phoneme sequence /kit/ from the portion of the speech signal used to generate the database 5 of FIG. 1 are labeled "KIT1" to "KIT5" for ease of discussion. Each of the illustrated two-formant trajectories represent the frequency values of the formant F1 for the respective phonetic sequence plotted against the frequency values of the corresponding formants F2 at particular points in time.

The frequencies of the formants F1 and F2 are represented on the X- and Y-axes, respectively. Particular points in time along the trajectory can be represented as corresponding labels as is shown on the trajectory 305. The illustration of two-dimensional trajectories in FIG. 4 is for ease of discussion and illustration purposes only and is not meant to be a limitation on the present invention. It is possible to use other N-dimensional representations including, for example, a three-formant or four-formant representation for phonetic segments having a vowel as the particular phoneme, and an amplitude and spectral tilt representation for segments having a consonant as the particular phoneme.

For ease of illustration and explanation purposes only, the cell size of the cells 310 within the representational space is set to one-quarter of the desired size of the tolerance region. When the tolerance region size is not substantially larger than the cell size, it is convenient to set the cell size as a multiple of the desired tolerance region size. In accordance with step 230 of the method 200 of FIG. 3, the determination of the tolerance region is based on the region that is intersected by the trajectories corresponding to different phoneme sequences. Accordingly, if a tolerance region of a 2×2 array of cells 310 is determined to be of sufficient size to produce a desired minimum sound quality then the region 320, which is intersected by the largest number of such trajectories, is the tolerance region.

A method for determining the cell with the largest number of such trajectory intersections is, for example, to perform a grid search of the cells in the representational space. According to this method, each cell 310 of FIG. 4 is examined and the number of trajectories corresponding to different phoneme sequences that intersect that cell or a predetermined resolution region of cells surrounding that cell 310 is determined. For instance, the number of trajectories intersections correspond to different phoneme sequences of cell 330 is two for the trajectories LID and MIK. A computationally simpler and faster method for determining the cell with the largest number of such trajectory intersections corresponding to different phonetic sequences is described in detail below with regard to FIG. 5.

Referring back to the method 200 of FIG. 3, after the trajectories are determined, then in step 240, particular phonetic sequences are selected for formation of the acoustic elements based on the corresponding trajectories proximity to the tolerance region 320. It is advantageous to include only one acoustic element in the database 5 for a particular phoneme sequence in order to minimize the space required for the database as well as simplicity of design of the speech synthesizer. Thus, either of the phonetic sequences /lik/ or /lid/ is selected for formation of the acoustic element [l–i] and either of the phonetic sequences /lik/ or /mik/ is selected for formation of the acoustic element [i–k]. In addition, one of the five phonetic sequences for the phoneme sequence /kit/ is selected for forming the acoustic elements [k–i] and [i–t]. However, it is possible for a more complex speech synthesizer employing a larger database to use multiple acoustic elements for a particular phoneme sequence based on the speech synthesis application. In constructing such a database, more than one and up to all phonetic sequences extracted form the speech signal that correspond to a particular phoneme sequence can be selected for forming acoustic elements.

If one acoustic element is to exist in the database 5 for a specific phoneme sequence, then identifying the particular one of a plurality of phonetic sequences corresponding to the same phoneme sequence for forming the acoustic element can be based on the relative proximity of the corresponding trajectories to the tolerance region. For instance, for the acoustic element [l–i], the phonetic sequence for "LID" whose trajectory LID intersects the tolerance region 320 is selected over the phonetic sequence "LIK" whose trajectory LIK does not intersect the tolerance region 320. Likewise, the phonetic sequence "MIK" would be selected for the acoustic element [i–k] over the phonetic sequence "LIK" for substantially the same reason. In the same manner, the phonetic sequence corresponding to the trajectory KIT5 would be selected over the other respective phonetic sequences "KIT" for both the acoustic elements [k–i] and [i-t].

Further, since acoustic elements can typically be concatenated at two boundary phonemes, the selection of the particular phonetic sequence used for formation of the acoustic elements should be based on the proximity of its trajectories for both of the boundary phonemes. Therefore, the particular phonetic sequence "MIK" or "LIK" whose trajectories are the overall closest to both the tolerance regions for the boundary phoneme /i/ as well as the boundary phoneme /k/ would be selected for forming the acoustic element [i–k].

Often, phonetic sequences corresponding to the same phoneme sequence will not have trajectories that the closest to the respective tolerance regions for both of its boundary phoneme. Such instances can occur when the source of the phonetic sequences are two different words containing the phoneme sequence. In such instances, it is preferable to select the phonetic sequence whose trajectories have an overall best quality. One exemplary method for selecting such a phonetic sequence is to assign a value to each of the phonetic sequences based on a particular quality measure to rank the phonetic sequences with regard to the corresponding boundary phonemes. The phonetic sequence with the overall best ranking would then be used for forming the acoustic element.

Referring back again to the method 200 of FIG. 3, after the phonetic sequences are selected for the acoustic elements, cut points of the phonetic sequences which are used to form the acoustic elements are determined in step 250. For instance, in FIG. 4, the cut points are based on time points in the respective trajectories that are within the tolerance region 320. For those trajectories that intersect the tolerance region 320, the selected cut points should preferably be time points along the trajectories that are approximately closest to a center point 340 of the tolerance region 320. For example, the closest time point on the trajectory 305 to the center point 340 is 160 ms in FIG. 4. As a consequence, the acoustic element /i–k/ is based on the corresponding phonetic sequence starting at time 160 ms.

For the trajectories that do not intersect the tolerance region 320, such as the trajectory LIK, the cut point should still be the time point along the trajectory that is closest to the tolerance region center point 340. Thus, if the phonetic sequence "LIK" was selected for forming the acoustic element, the proper cut point would correspond to the time point 350 on the trajectory LIK. It should be understood that a relatively larger discontinuity would result at the phoneme /i/ when using this phonetic sequence for forming the acoustic element. Accordingly, it may be desirable to obtain other speech segments for the phoneme sequence /lik/ to determine if they would be better candidates for forming the acoustic element.

In the method 200 of FIG. 3, after the cut points are determined in step 250, the acoustic elements are formed based on the selected phonetic segments and the determined cut points. The acoustic elements can be maintained in the database 5 of FIG. 1 in the form of, for example, digitized speech signals or LPC parameters corresponding to the phonetic sequences starting and ending at the respective cut points. Also, longer sequences can be stored in the database 5 along with starting and ending values that correspond to the particular cut points for the respective acoustic elements. The acoustic element retrieval processor 15 of FIG. 1 would then extract the proper acoustic element from these longer sequences based on these values. It should be readily understood that the particular organizational method used for the database 5 should not be a limitation and any organization can be used to store the acoustic elements formed in accordance with the present invention. In order to synthesize the multitude of utterances of a particular language, acoustic elements for all the elementary phoneme sequences of that language should be created.

Figure 5:
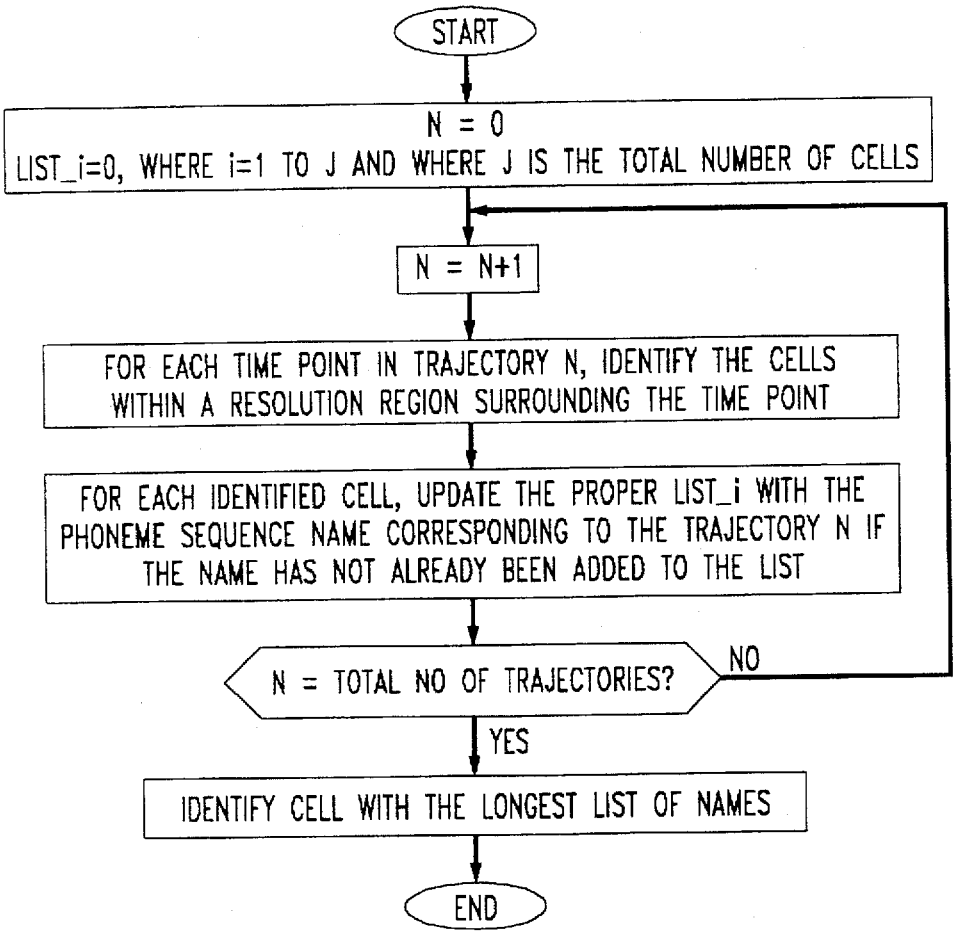
FIG. 5 illustrates a flow chart of an exemplary method of determining a tolerance region for use in the method of FIG. 3

The surprising use of a heightened diversity of trajectories in determining the position of the tolerance region according to the present invention results in acoustic elements that produce smaller discontinuities upon concatenation. For example, in FIG. 4, region 360 corresponds to the region that is based on all the trajectories and is intersected by, or closest to the overall largest number of such trajectories due to five trajectories for the phoneme sequence /kit/. However, it can be seen that the closest time points on the trajectories LID and MIK to the region 360 would produce relatively large discontinuities upon concatenation of corresponding acoustic elements. In contrast, the tolerance region 320 is not skewed by the multiple instances of the phoneme sequence /kit/ and the corresponding distance between all the selected trajectories to the tolerance region 320 is much smaller and would minimize any corresponding discontinuities FIG. 5 depicts an exemplary method 400 according to the present invention for determining the cell with the largest number of trajectory intersections correspond to different phonetic sequences for use in step 230 in FIG. 3. For ease of discussion, each trajectory is referred to by a unique integer in FIG. 5 instead of the corresponding phonetic sequence label that is used in FIG. 4. For instance, the nine trajectories illustrated in FIG. 4 are referred as trajectories 1–9 in FIG. 5. Such labeling of the trajectories is consistent with conventional pointers used in data structure representations, such as in arrays or tables.

According to the method 400, an integer N and a plurality of lists LIST_i are initialized to zero in step 410. The number i of lists in the plurality of lists LIST_i corresponds to the number of cells in the representational space. The integer N is then incremented in step 420. Then, for each time point in the trajectory N, the cells that are within a resolution region surrounding the respective time point are identified in step 430. For convenience the resolution region can be the same size as the tolerance region. However, the resolution region can also be a different size in accordance with the present invention if so desired. If the resolution region is selected to be a region covered by a 2×2 cell array, the resolution region surrounding a time point 505 at the time 0.095 ms of the trajectory 305 in FIG. 4 would include cells 511, 512, 513 and 514 that are surrounded by an outline 510.

After the cells within the resolution regions are identified in step 430, the respective lists LIST_i for the identified cells are updated with the name of the phoneme sequence for the corresponding trajectory N. Also, in step 440, the name of the phoneme sequence is only added to the list if it does not already appear on the list for that cell. Accordingly, assuming the name "LID" does not appear in the lists LIST_i for the cells 511–514 in the above described example, then the lists LIST_i for these cells would be updated with that name. The lists LIST_i for the cells which are within resolution regions for the other time points along the trajectory 305 would also be updated with the name "LID" in substantially the same manner.

After all the cells within the identified resolution regions of a particular trajectory N are updated in step 440, the method determines if the integer N is equal to the total number of trajectories in step 450. If the method determines that N is not equal to the total number of trajectories then the method 400 performs the steps 420–440 to update the lists LIST_i based on time points of the next trajectory N. However, if the method determines that N is equal to the total number of trajectories then all the trajectories have been processed and all the lists LIST_i within resolution regions have been updated and the method 400 proceeds to step 460. In step 460, the tolerance region is determined from the cell or region of cells having the largest number of names in the corresponding list or lists LIST_i. Since the method 400 only examines and updates those cells that are within resolution regions of trajectory time points it is computationally simpler and faster than grid search methods which examine each cell individually.

In the method 400, step 430 first detect all the cells within resolution regions for time points of a particular trajectory before the corresponding cell lists are updated in step 440. However, it should be understood that the sequence of the steps shown in FIG. 4 is for illustration purposes only and is not meant to be a limitation of the present invention. The sequence of such steps can be performed in a variety of different ways including updating a list LIST_i immediately after its respective cell is determined to be within a resolution region of a particular trajectory time point.

In an alternative embodiment, the identity of the cell with the longest list LIST_i can be maintained through out the cell list update process by storing and updating the identity of the cell with the longest list LIST_i and the corresponding maximum list length. As each cell list is updated, the total number of names contained in that list can be compared against the stored value for the longest list. If the number of names in a list exceeds that of the stored cell identity then stored cell identity and maximum list length would be updated, accordingly. In this manner, the identity of the cell corresponding to the tolerance region would be known upon processing the last time point of the last trajectory without any further processing steps.

If the cells lists are indexed, such as, for example, in the form of data structures with integer values designating the cells position within the representational space then a computationally simple and faster method can be employed. For instance, the cell lists for the cells 310 in FIG. 4 can be indexed in a manner corresponding to their X- and Y-coordinates. Conversion values are then used to convert the trajectory time point values to index values indicating the time points' relative coordinate position based on the indexed cells. Then, resolution values are added to and subtracted from the converted index values to identify the index numbers of the cells within the resolution region of that point. The lists LIST_i of the respective cells within the resolution region are then updated accordingly.

Thus, for the example shown in FIG. 4, the formant F1 and F2 frequency values of the time point 505 of the trajectory 305 in FIG. 4 can be multiplied by conversion factors to obtain converted values x=3.5 and y=3.5 indicating that it is in between the third and fourth cells of both the X- and Y-direction, respectively. Thus, if the resolution region is a 2×2 cell array then resolution values of ±1 need to be added to the converted values and rounded to the closest position to yield that the cell lists for cells within the resolution region 510 have coordinates (3, 3), (3, 4), (4, 3) and (4, 4), corresponding to cells 511–514, respectively, and would be updated with the phoneme sequence name "LID".

Although several embodiments of the present invention have been described in detail above, many modifications can be made without departing from the teaching thereof. All of such modifications are intended to be encompassed within the following claims. For instance, although the present invention has been depicted with two-dimensional rectangular cells and tolerance regions, it is possible to use any N-dimensional closed shape for the cells and regions consistent with an N-dimensional representational space including cubes, boxes, spheres and spheroids. Further, The invention is particularly useful in a variety of speech synthesis applications including text-to-speech synthesis and voice response systems.

The invention claimed is:

1. A method for producing synthesized speech, the method including an acoustic element database containing acoustic elements that are concatenated to produce synthesized speech, the acoustic element database established by the steps comprising:

for at least one phoneme corresponding to particular phonetic segments contained in a plurality of phonetic sequences occurring in an interval of a speech signal, determining a relative positioning of a tolerance region within a representational space based on a concentration of trajectories of the phonetic sequences that correspond to different phoneme sequences which intersect the region, wherein each trajectory represents an acoustic characteristic of at least a part of a respective phonetic sequence that contains the particular phonetic segment; and forming acoustic elements from the phonetic sequences by identifying cut points in the phonetic sequences at respective time points along the corresponding trajectories based on the proximity of the time points to the tolerance region.

2. The method of claim 1 further comprising the step of selecting at least one phonetic sequence from the plurality of phonetic sequences which have portions corresponding to a particular phoneme sequence based on the proximity of the corresponding trajectories to the tolerance region, wherein an acoustic element is formed from the portion of the selected phonetic sequence.

3. The method of claim 1 wherein the step of forming the acoustic elements identifies the cut points of each of the phonetic sequences at a respective time point along the corresponding trajectory that is approximately the closest to or within the tolerance region.

4. The method of claim 3 wherein the step of forming the acoustic elements identifies the cut points of each of the phonetic sequences at a respective time point along the corresponding trajectory that is approximately the closest to a center point of the tolerance region.

5. The method of claim 1 wherein an acoustic element is formed for each anticipated phoneme sequence for a particular language.

6. The method of claim 1 wherein the trajectories are based on formants of the phonetic sequences.

7. The method of claim 1 wherein the trajectories are based on a three-formant representations and the representational space is a three-formant space.

8. The method of claim 1 wherein the representational space is an N-dimensional space that includes a plurality of contiguous N-dimensional cells and wherein the step of determining the tolerance region further comprises performing a grid search to determine a region of at least one cell that is intersected by the substantially largest number of trajectories corresponding to different phoneme sequences.

9. The method of claim 1 wherein the representational space is an N-dimensional space that includes a plurality of contiguous N-dimensional cells and wherein the step of determining the tolerance region comprises:

identifying those cells that are within a resolution region surrounding time points along each trajectory;

for each identified cell within the resolution region, updating a list maintained for that cell with an identification of the phoneme sequence that corresponds to the trajectory if such identification does not appear in the list for that cell; and determining the tolerance region corresponding to at least one cell having a greater than average number of identifications on its list.

10. The method of claim 9 wherein the step of identifying those cells that are within a resolution region comprises processing the time points along the trajectories and updating lists associated with the cells within the corresponding resolution regions.

11. The method of claim 9 wherein the resolution region and the tolerance region are of the same size.

12. The method of claim 1 wherein the representational space is an N-dimensional space that includes a plurality of contiguous N-dimensional cells and wherein the step of determining the tolerance region comprises:

identifying those cells that are within a resolution region surrounding time points along each trajectory;

for each identified cell within the resolution region, updating a list maintained for that cell with an identification of the phoneme sequence that corresponds to the trajectory;

removing multiple identifications from each cell list; and determining the tolerance region corresponding to at least one cell having a greater than average number of identifications on its list.

13. The method of claim 12 wherein the step of identifying those cells that are within a resolution region comprises processing the time points along the trajectories and updating lists associated with the cells within the corresponding resolution regions.

14. The method of claim 12 wherein the resolution region and the tolerance region are the same size.

15. The method of claim 1 wherein at least two phonetic sequences of the plurality of phonetic sequences have portions corresponding to a particular phoneme sequence, the method further comprising the step of:

determining a value for each section of the phonetic sequences based on the corresponding trajectories' proximity to the tolerance region, wherein the acoustic element for the particular phoneme sequence is formed from one of the corresponding portions of the phonetic sequences based on the determined values.

16. The method of claim 15 wherein the step of determining the values is further based on a quality measure of the corresponding phonetic sequence.

17. The method of claim 16 wherein the quality measure is determined from the proximity of a trajectory to a tolerance region for the phonetic sequence corresponding to a different boundary phoneme.

18. An apparatus for producing synthesized speech, the apparatus including an acoustic element database containing acoustic elements that are concatenated to produce synthesized speech, the acoustic element database established by the steps comprising:

for at least one phoneme corresponding to particular phonetic segments contained in a plurality of phonetic sequences occurring in an interval of a speech signal, determining a relative positioning of a tolerance region within a representational space based on a concentration of trajectories of the phonetic sequences that correspond to different phoneme sequences which intersect the region, wherein each trajectory represents an acoustic characteristic of at least a part of a respective phonetic sequence that contains the particular phonetic segment; and forming acoustic elements from the phonetic sequences by identifying cut points in the phonetic sequences at respective time points along the corresponding trajectories based on the proximity of the time points to the tolerance region.

19. The apparatus of claim 18 wherein the representational space is an N-dimensional space that includes a plurality of contiguous N-dimensional cells and wherein the step of determining the tolerance region comprises:

identifying those cells that are within a resolution region surrounding time points along each trajectory;

for each identified cell within the resolution region, updating a list maintained for that cell with an identification of the phoneme sequence that corresponds to the trajectory if such identification does not appear in the list for that cell; and determining the tolerance region corresponding to at least one cell having a greater than average number of identifications on its list.

20. The apparatus of claim 19 wherein the step of identifying those cells that are within a resolution region comprises processing the time points along the trajectories and updating lists associated with the cells within the corresponding resolution regions.

21. The apparatus of claim 18 wherein the representational space is an N-dimensional space that includes a plurality of contiguous N-dimensional cells and wherein the step of determining the tolerance region comprises:

identifying those cells that are within a resolution region surrounding time points along each trajectory;

for each identified cell within the resolution region, updating a list maintained for that cell with an identification of the phoneme sequence that corresponds to the trajectory;

removing multiple identifications from each cell list; and determining the tolerance region corresponding to at least one cell having a greater than average number of identifications on its list.

22. The apparatus of claim 21 wherein the step of identifying those cells that are within a resolution region comprises processing the time points along the trajectories and updating lists associated with the cells within the corresponding resolution regions.

* * * * *